United States Patent [19]

Skaar et al.

[11] Patent Number: 4,992,146

[45] Date of Patent: Feb. 12, 1991

[54] METHOD FOR SETTING ELECTRODES IN ALUMINUM ELECTROLYSIS CELLS

[75] Inventors: Odd Skaar; Kurt Nilsson, both of Ovre Årdal, Norway

[73] Assignee: Norsk Hydro, a.s., Oslo, Norway

[21] Appl. No.: 286,790

[22] Filed: Dec. 20, 1988

[30] Foreign Application Priority Data

Dec. 30, 1987 [NO] Norway ..... 875429

[51] Int. Cl.[5] ..... C25C 3/10; C25C 3/12

[52] U.S. Cl. ..... 204/67; 204/225

[58] Field of Search ..... 204/67, 225

[56] References Cited

U.S. PATENT DOCUMENTS 3,480,526 11/1969 Duclaux ..... 204/225 X
3,705,842 12/1972 Barbato ..... 204/225 X
4,540,474 9/1985 Voegel ..... 204/225 X

*Primary Examiner*—Donald R. Valentine
*Attorney, Agent, or Firm*—Wenderoth, Lind & Ponack

[57] ABSTRACT

A method is proposed for the setting of electrodes in electrolysis cells, especially the setting of carbonaceous anodes (3) in cells (1) for producing aluminium according to the Hall-Heroult process, where the cathode of the cells contains a bath (13) of aluminium oxide dissolved in melted cryolite, and where the aluminium metal is deposited on the bottom of the cathode. The method is characterized in that each anode, in connection with their production (assembly), is provided with reference marks (16 and 17), for instance by providing the anode rod with a paint mark, which defines a predetermined distance from the bottom side of the anode to the cathode. The anodes thereafter are positioned or set according to a rule (18) having reference points (19) each defining the expected anode consumption pr. unit of time, whereby the reference mark (16 or 17) on the anode rod should correspond to a reference point (19) on the rule (18) which is in accordance with the expected setting height. The rule (18) for each anode is fixed, for instance to the anode bars (7) of the cells, in a predetermined and equal distance from the metal plane (15). By this setting method a more even current absorption is achieved and the carbon consumption is reduced.

7 Claims, 2 Drawing Sheets

METHOD FOR SETTING ELECTRODES IN ALUMINUM ELECTROLYSIS CELLS

BACKGROUND OF THE INVENTION (1) Field of the Invention

The present invention relates to a method of setting electrodes in electrolysis cells, especially setting of carbonaceous anodes in cells producing aluminium by electrolysis according to the Hall-Heroult process.

(2) State of the Prior Art

Aluminium is mostly produced by electrolysis of aluminium oxide dissolved in a cryolite bath. The electrolysis cells allowing this consist of a carbon cathode disposed in a steel shell which on the inside is isolated with refractory materials. Above the carbon cathode is provided a carbon anode or a number of rechangeable carbon anodes which are partly submerged in the cryolite bath and which are gradually reduced by the oxygen originating from the decomposing of the aluminium oxide.

Electric current is led from the top to the bottom of the cells, and the cryolite is kept melted by means of the Joule-effect at a temperature close to the solidification temperature. The most common operating temperatures for these cells lies between 930° and 980° C. The aluminium produced is therefore in a liquid state, and deposits, due to gravity, on the cathode.

The carbon anodes are fixedly attached to so-called anode hangers which are securely held to an anode bar for mechanical and electrical connection. As the carbon anodes are consumed and metal is charged from the cells (the metal represents the actual cathode), the anode bar is lowered to keep a constant distance between the cathode and the carbon anodes.

An electrolysis cell of common size is usually provided with approximately 20 carbon anodes, and since the anodes are consumed gradually, each anode has to be replaced by a new one after 20–24 days. Thus, in each cell a used anode is replaced by a new one every day.

According to the conventional setting method, the new anodes are set or positioned so that the distance from the bottom side of these to the cathodes is the same as the distance for the old ones being exchanged. The exchange of anodes is carried out in different ways. The most common way of doing it is by providing the old (used) anode, or rather the anode hanger, with a chalk mark referring to a reference point on the anode bar, usually the bottom side of the anode bar. The used anode is then placed alongside a new anode on the floor, and the measurement marked with the chalk mark on the old anode is transferred onto the new one, and the new anode is thereafter inserted in the cell.

The above described manual method for setting the anodes is, however, liable to error, caused by the width of the chalk mark, errors of parallax during the transference of the measurements from the old anode to the new anode, irregularities of the surface on which they are placed, etc.

The errors and irregularities result in that the anodes are not positioned at the correct level in the cells, and this will result in unwanted operational disturbances (uneven current absorption, carbon slipping etc.), causing economic losses.

A mechanical device which is based on the conventional method is described in GB patent application No. 2.018.291. The device comprises a crane which is employed to exchange old anodes with new ones. Thus, the old anode is pulled out until, after passing through a certain travel distance, the surface facing the cathode has reached a predetermined horizontal plane. The distance travelled until then is stored. The new anode is positioned with the surface facing the cathode in a second horizontal plane and is lowered towards the cathode in accordance with measurement of the stored level, the distance between the two horizontal planes, and possibly with regard to different saggings of the crane caused by the different weights of the new and old anode.

Even though this mechanical device has eliminated some of the subjective measuring errors, the device is encumbered with objective measuring errors which have influence on the positioning of the anodes. Besides, the above-mentioned device is expensive to produce.

As previously mentioned, incorrect setting of the anodes will give economic operational losses due to disturbances under the electrolysis process. A further disadvantage with the conventional setting method is an increase in anode consumption.

SUMMARY OF THE INVENTION

With the present invention it is a primary object to provide a method for setting (positioning) anodes in electrolysis cells by which the above disadvantages are eliminated, i.e. where:

- a more even current absorption is achieved, whereby the anode slipping is reduced and repositioning of the anodes is avoided,
- the control level is raised due to the fact that a systematic source regarding variation in current absorption is eliminated,
- there is achieved a greater chance to reveal problems connected to the anode-exchange routine, such as anode carbon remainders, mud etc. being present under the anodes,
- the anode consumption is reduced as the anode endurance principally is governed by the "smallest critical anode butts",
- it is possible to increase the size of the electrolysis cells without having to use individual anode regulating means.

BRIEF DESCRIPTION OF THE DRAWINGS

Preferred embodiments of the invention will now be described and with reference to the accompanying drawings, in which.

DESCRIPTION OF THE PREFERRED EMBODIMENTS

Figure 1:
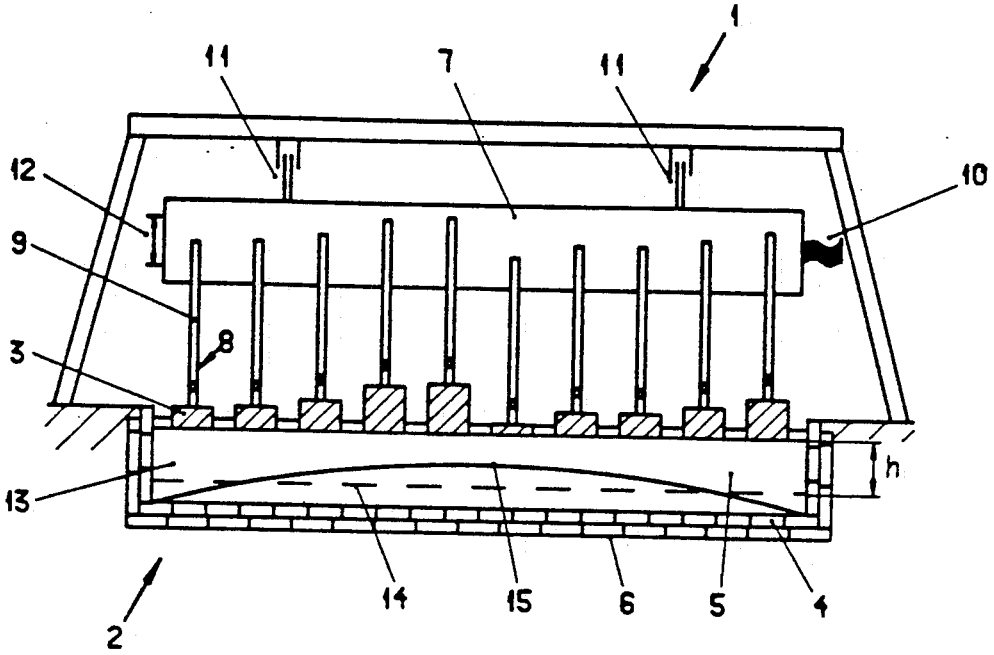
FIG. 1 shows a simplified longitudinal section of an electrolysis cell in which a conventional setting method for anodes is used.
Figure 2:
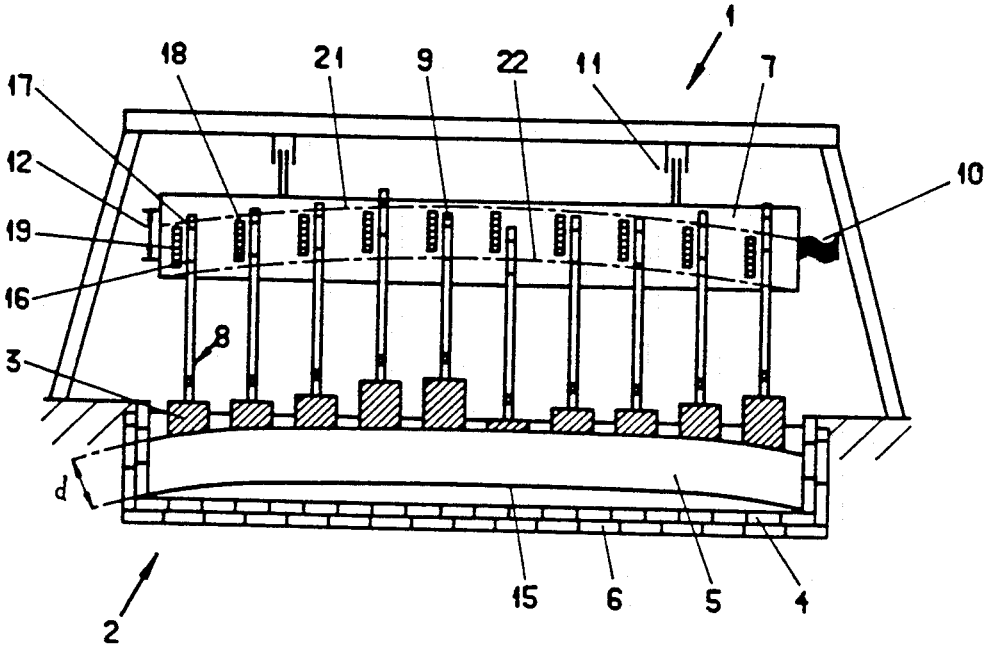
FIG. 2 shows a simplified longitudinal section of an electrolysis cell where a setting method according to the present invention is used.

As mentioned initially and as shown in FIGS 1 and 2, a Hall-Herould electrolysis cell for producing aluminium principally consists of a cathode 2 and one or more carbon anodes 3 provided above the cathode. The cathodes, which contains a cryolite bath, is made of carbon blocks 4 placed in an internally isolated steel shell. The carbon blocks are connected to current leads by means of steel bars extending completely way through the cathode (not shown).

The carbon anodes 3 are cast or in some other way fixedly connected to anode hangers 8, which in turn are releasably connected to an anode bar 7 by means of connectors (not shown). Electric current is supplied to the anode bar via flexible connection 10, and the anode bar 7 is lowered and lifted in a regulation zone 12 by means of jacks 11.

The elctric current is led, as will be apparent above, from the top to the bottom of the cells. On the bottom side of the anodes, the aluminium oxide dissolved in the bath 13 is decomposed to aluminium metal and oxygen. The aluminium is, due to gravitational forces, deposited on the cathode, while the oxygen imediately reacts with the carbon of the anode to form carbon dioxide. To maintain a constant distance to the cathode, the anodes are lowered. This is done by lowering the anode bar 7 by means of the jacks 11. When the anode bar 7 with the carbon anodes has reached its lower-most position, the anode bar has to be lifted—so called "cross lifting"—while the anode hangers are intermediately mechanically fixed to an assisting bar, called a raiser.

As previously mentioned, there are about 20 carbon anodes in an electrolysis cell, and since the anodes are gradually consumed, each anode has to be exchanged after approx. 20–24 days. In each cell there is thus about one anode exchange every day.

In FIG. 1 the anodes are positioned according to the conventional setting method. Since this setting method has been previously described, only the disadvantages will now be mentioned.

The main principle of the conventional setting method resides in that the new anodes should be positioned at the same level h above the cathode as the old anodes. In practice it has been shown, however, that in connection with the anode exchange several errors occur which result in relatively large deviations in the setting height for the anodes. These setting deviations cause inreased anode consumption and simultaneously lead to operational disturbances due to the fact that the new anodes either draw too much or too little electric current. The relations are as follows:

If the anodes are positioned too low (short interpolar distance between the anode and the cathode) the current consumption is increased, and, accordingly, the anode consumption increases. However, if the anodes are positioned too high, the current, and thus the anode consumption, is reduced.

In FIG. 2 is shown a similar electrolysis cell as is shown in FIG. 1, but in which the anodes are positioned according to the present invention. The method will be desribed as follows:

When manufacturing new anodes, or, rather, when the anode hangers are assembled to the anode carbons, the anode hangers are provided with one or preferably two reference marks 16, 17. The reference marks may be in the form of a readily removeable paint and is painted at a predetermined distance from the bottom side of the carbon anodes, the distance which is equal for all the anodes. A fixed rule 18 is provided having markings 19 in a vertically, spaced apart relation. The distance between each reference point 19 defines the expected anode consumption per unit of time. This anode, consumption is dependent upon several factors such as carbon quality and current density.

The rule 18 is thereafter fixedly positioned on the anode bar 7, one for each anode, in the cell and at a distance from a metal plane 15 (the surface limit between the bath and metal), which is equal for each of the anodes. The rule 18 may be drawn on paper which is then glued onto the anode bar, or it can be painted or drawn directly on the anode bar.

The reference points 19 on the rule 18 are provided with numbers 1,2,3 etc. (not shown) in an upwardly increase order (not shown). The length of the rule is dependent upon the length of the regulation zone 12 for the anode bar and how large a part of the anodes can be consumed. Hence, the rules have to be longer than the sum of the length of the regulating zone for the anode bar and the length of the maximum anode consumption.

During testing of the setting method according to the invention it was found that the rule had to be approx. 80 cm long. Further, the anode consumption was calculated to be 1.6 cm/24h. Thus it was found that the rule should contain approx. 50 marks. Instead of using only one reference mark on the anode hanger and a rule being 80 cm long, it was experienced that the anode hanger could be provided with two reference marks with a spacing of about 40 cm to be able to shorten the rule to half the length, i.e. 40 cm with 25 marks. The lowermost reference mark 16 on the anode hanger will thus for the most part be employed when new anodes are positioned in the cell, while the uppermost reference mark 17 on the anode hanger for the most part will be employed when "crossing" of the anode bar takes place.

As mentioned above, the rules 18 are positioned at a distance from the metal/bath surface limit which is equal for all of the anodes. If a line is thus drawn along the anode bar which toches the upper end 21 or lower end 22 of the rules, it will have a shape which to a large extent corresponds to the curved metal plane.

In connection with the anode exchange, the new anodes are positioned according to the expected setting height, i.e. the reference mark 16 or 17 on the anode rods 9 is placed in correspondance with the topical reference point (setting point) 19 on the rule 18 for the anode bar.

The calculation of the setting point is normally accomplished by means of a calculator which adds one reference point 19 (1.6 cm) for each day. When deviation occurs, for instance if the current consumption increases for every passing day, the calculator will decide to reduce the current consumption and give a signal indicating that the anode should be repositioned at a higher level (one reference mark) above normal setting height. The results are presented each day on a daily set-list used by the carbon exchange operators.

With the here described method a considerably more accurate setting/positioning of the anodes is achieved, thereby reducing the anode consumption, due to the fact that several sources of errors are eliminated. Further, a more even current distribution in the cells is achieved giving further reduction to the anode consumption as the distance between each of the anodes in the cells and the underlaying metal plane is equal.

As to the metal plane, it can be calculated by measurements or theoretically by means of magneto hydrodynamic models. It will be further described below how the metal plane preferably can be calculated by means of measurements.

The above-mentioned rules 18 are fixedly positioned on an anode bar in an electrolysis cell in the same horizontal plane, and the anodes are positioned according to the same reference mark, i.e. the bottom side of the anodes are positioned in the same horizontal plane.

Figure 3:
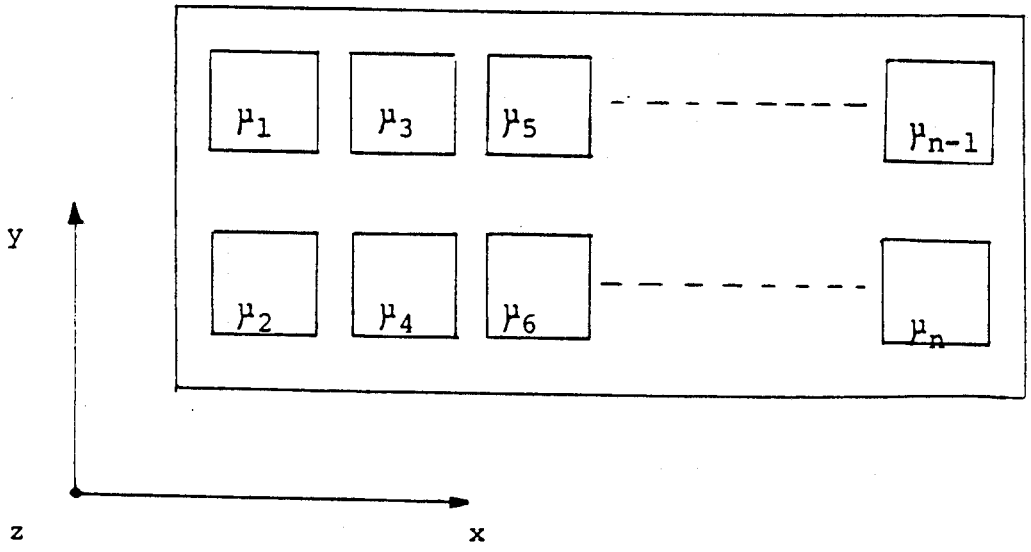
FIG. 3 schematically shows horizontal positions for "n" anodes in an elecrolysis cell.

A statistic material is worked out in the form of measured current consumption I for anodes with an operational time of 24 h. This is done for each anode position in the horizontal plane. FIG. 3 shows schematically the horizontal positions for n anodes in an elecrolysis cell. $\mu_j$ can for instance represent the arithemtic average of m singular current consumption measurements, I, and which gives the equation:

$$\mu j = \frac{1}{m} \sum_{i=1}^{m} I_1, \text{ or generally}$$

$$\mu = E(I) = \int_{+\infty}^{+\infty} I \cdot P(I) \cdot dI.$$

where E(I) is the expected value of the current consumption I and p(I) is the probability density distribution for the current I.

With a reasonable statistical basis, i.e. more than 100 measurements for each of the n anodes, it is possible to determine the current consumption distribution for the cell.

To be able to calculate the height of the metal plane underneath each anode, it is necessary to find the correlation between the distance from the bottom side of the anode to the metal plane d and the current consumption I.

This is done by studying the reaction of the current consumption when the anodes are positioned at an abnormal height, Z. Normally, when the anode is positioned at a point of time k, it is positioned 1.6 cm (one mark) higher than the anode positioned at a point of time k−1 (assuming that the difference of time is 24 hours). The probability value for the difference between the current consumption for the anodes positioned at the point of time k and k−1 is then zero.

$$E(I_k - I_{k-1}) = 0$$

This is under the assumption that the stipulated anode consumption is 1.6 cm/24 h.

By positioning the anode "abnormal", i.e. not 1.6 cm higher than the previous anode, but for instance 0 cm or 2×1.6 cm higher (so-called stop or hop corrective attempts), the probability value will be unequal to zero:

$$E(I_k - I_{k-1}) = E(\partial I) \neq 0$$

$\partial I$ is the response of one pertubation $\partial z$ which is + or −1.6 cm with regard to what is "normal". Thus, a relation is given between the current consumption and the positioning of the anode, relative to the metal plane:

$$\partial I / \partial Z$$

By gathering a statistical basis of many corrective attempts (hop/stop), one can find an estimator for the probability value for $\partial I/\partial Z$, for instance the arithmetic value which has the correct probability when/if $\partial I/\partial Z$ has a normal distribution.

With the estimator $\widehat{\partial I/\partial Z}$ it is now possible to get back to the previously mentioned current consumption distribution, and the curvature displacement of the metal plane relative to the average metal height can be estimated according to the equation:

$$DZ_j = (\widehat{\mu}_j - \overline{\widehat{\mu}})/(\widehat{\partial I/\partial Z}),$$

where $DZ_j$ is the displacement below the anode position j, $\widehat{\mu}_j$ is the estimated current consumption of the anode position j and $\overline{\widehat{\mu}_j}$ is the average current consumption for all the anode positions, n.

We claim:

1. A method of setting and positioning electrodes in electrolysis cells, wherein said cells are Hall-Herould process aluminum production cells comprising a cathode forming a bath for having aluminum oxide dissolved in melted cryolite therein, and said electrodes are carbonaceous anodes, said method comprising the steps of;

providing an anode rod for each said anode;

providing a reference mark on each said anode rod defining a predetermined distance from the bottom of each said anode;

providing a rule for each said anode, each said rule having a plurality of reference points thereon, each said reference point corresponding to an expected amount of consumption per unit of time of a said anode;

providing an anode bar for supporting said anode rods;

determining the expected surface level of aluminum in said bath;

placing said rules for said respective anodes on said anode bar equidistantly from said expected aluminum level; and positioning said anode rods with said anodes on said anode bar with said reference mark of said anode rods corresponding to a said reference point on each respective said rule such that said anodes are positioned equidistantly, from their respective bottoms, relative to said expected level of aluminum.

2. The method as set forth in claim 1, wherein:

said step of providing a rule for each said anode comprises providing each said reference point on said respective rules such that said reference points correspond to an expected amount of anode consumption of 1.2–2.0 cm/h.

3. The method as set forth in claim 1, wherein:

said step of providing a reference mark on each said anode rod further comprises providing two said reference marks vertically spaced on each said anode rod.

4. The method as set forth in claim 1, wherein said step of determining the expected surface level of aluminum in said bath comprises:

fixedly positioning said rules on said anode bar in the same horizontal plane such that said anodes are set according to the same reference point with their respective bottom sides situated in the same horizontal plane;

determining a statistical model of the current consumption of said anodes according to their respective position in said horizontal plane according to the equation $$\mu = E(I) = \int_{+\infty}^{+\infty} I \cdot P(I) \cdot dI.$$

wherein $\mu$ is the arithmetic average of singular current consumption measurements, I is the current consumption, E(I) is the probability value of said current consumption and P(I) is the probability density distribution of said current consumption;

finding the relation between the distance from said bottom side of said anodes to said surface level and said current consumption I by setting the probability value for the difference between the current consumption for anodes positioned at points of time k and k−1 not equal to zero, $$E(I_k - I_{k-1}) = E(\partial I) \neq 0,$$

wherein ∂I is a response of a perturbation ∂Z one reference point higher or lower relative to a normal point such that there is a relation value between said current consumption and the positioning of said anodes relative to said surface level ∂I/∂Z; and calculating the deflection or curvature of said surface at said respective anode positions relative to the average metal surface height with the equation $$DZ_j = (\hat{\mu}_j - \bar{\hat{\mu}})/(\partial I/\widehat{\partial Z}),$$

wherein $DZ_j$ is the deflection of said surface height at an anode position j, $\hat{\mu}_j$ is an assumed current consumption for said anode position j, $\hat{\mu}$ is the average current consumption for all of said anode positions, and $(\partial I/\widehat{\partial Z})$ is an estimator for the probability value of ∂I/∂Z.

5. A method of replacing electrodes in electrolysis cells, comprising:

providing an electrode bar and a plurality of electrodes to be supported thereon, each said electrode having an electrode rod extending therefrom;

positioning a plurality of rules corresponding in number to said plurality of electrodes on said electrode bar, each said rule having a plurality of reference points thereon corresponding to expected amounts of electrode consumption per unit time, said rules being positioned on said electrode bar equidistantly from an electrolysis cell surface;

providing each said electrode rod with at least one reference mark thereon;

positioning each said electrode rod on said electrode bar such that said reference mark corresponds to a reference point on its respective said rule and such that each said electrode is equidistant, with respect to its lower surface, from said electrolysis cell surface; and replacing used electrodes by calculating the number of reference points corresponding to the expected amount of consumption of said used electrode and hanging a new electrode on said electrode bar with its reference mark said number of reference points higher than the reference mark of said used electrode.

6. The method as set forth in claim 5, and further comprising:

determining the expected relative surface level of said electrolysis cell surface.

7. The method as set forth in claim 6, wherein said step of determining the expected relative surface level of said electrolysis cell comprises:

fixedly positioning said rules on said electrode bar in the same horizontal plane such that said electrodes are set according to the same reference point with their respective bottom sides situated in the same horizontal plane;

determining a statistical model of the current consumption of said electrodes according to their respective position in said horizontal plane according to the equation $$\mu = E(I) = \int_{+\infty}^{+\infty} I \cdot P(I) \cdot dI,$$

wherein μ is the arithmetic average of singular current consumption measurements, I is the current consumption, E(I) is the probability value of said current consumption and P(I) is the probability density distribution of said current consumption;

finding the relation between the distance from said bottom side of said electrodes to said surface level and said current consumption I by setting the probability value for the difference between the current consumption for electrodes positioned at points of time k and k−1 not equal to zero, $$E(I_k - I_{k-1}) = E(\partial I) \neq 0$$

wherein ∂I is a response of a perturbation ∂Z one reference point higher or lower relative to a normal point such that there is a relation value between said current consumption and the positioning of said electrodes relative to said surface level ∂I/∂Z; and calculating the deflection or curvature of said surface at said respective electrode positions relative to the average metal surface height with the equation $$DZ_j = (\hat{\mu}_j - \bar{\hat{\mu}})/(\partial I/\widehat{\partial Z}),$$

wherein $DZ_j$ is the deflection of said surface height at an electrode position j, $\hat{\mu}_j$ is an assumed current consumption for said electrode position j, μ is the average current consumption for all of said electrode positions, and $(\partial I/\partial Z)$ is an estimator for the probability value of $\partial I/\widehat{\partial Z}$.

* * * * *